United States Patent [19]

Feuer

[11] 4,200,222

[45] Apr. 29, 1980

[54] GREETING CARD WITH REMOVABLE DECAL

[76] Inventor: Erwin P. Feuer, 1865 Brickell Ave., Miami, Fla. 33129

[21] Appl. No.: 969,816

[22] Filed: Dec. 15, 1978

[51] Int. Cl.[2] ..... B42D 15/00

[52] U.S. Cl. ..... 229/92.8; 40/158 R; 40/594; 206/813; 229/92.3

[58] Field of Search ..... 229/92.8, 92.3; 40/158 R, 594; 206/813; 428/914

[56] References Cited

U.S. PATENT DOCUMENTS

| | | | |
|---|---|---|---|
| 2,363,472 | 11/1944 | Ritter | 229/92.8 |
| 2,547,359 | 4/1951 | Bacharach | 40/158 R X |
| 2,805,816 | 9/1957 | Morgan | 229/92.8 |
| 3,174,244 | 3/1965 | Walton | 229/92.3 |
| 3,713,238 | 1/1973 | Hyman et al. | 229/92.8 |
| 4,008,851 | 2/1977 | Hirsch | 206/813 X |
| 4,008,852 | 2/1977 | Davis | 229/92.8 X |

FOREIGN PATENT DOCUMENTS

| | | | |
|---|---|---|---|
| 579278 | 7/1959 | Canada | 229/92.8 |

*Primary Examiner*—Stephen P. Garbe
*Attorney, Agent, or Firm*—Malin & Haley

[57] ABSTRACT

A greeting card with a removable decal, secured to one side by adhesive. A foldable side with an opening having the general outline of the decal, but of smaller perimeter, allows viewing of the decal when the card is folded closed and also assists in maintaining the decal in viewable register with the opening in the card. When the decal, which has an adhesive backing covered by a protective material, is removed from the greeting card, it may be applied to another surface.

2 Claims, 4 Drawing Figures

Fig. 1.
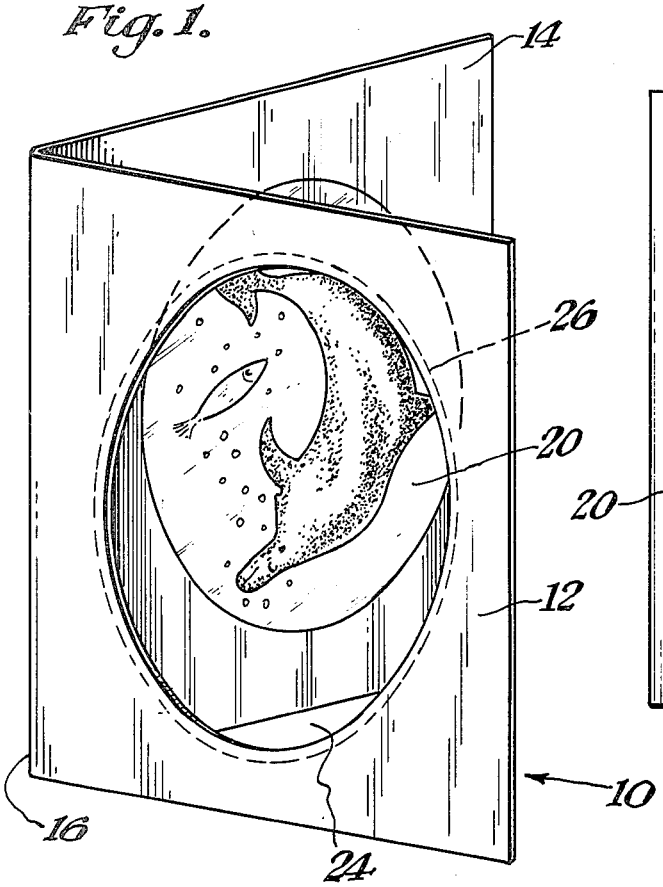
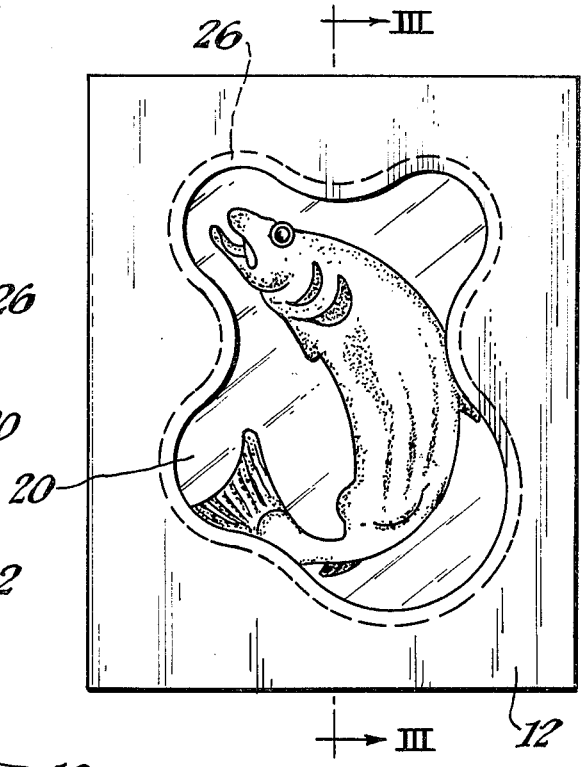
Fig. 2.
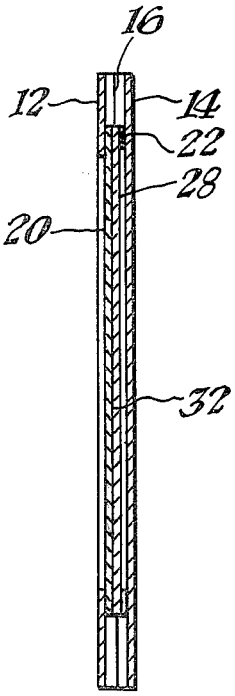
Fig. 3.
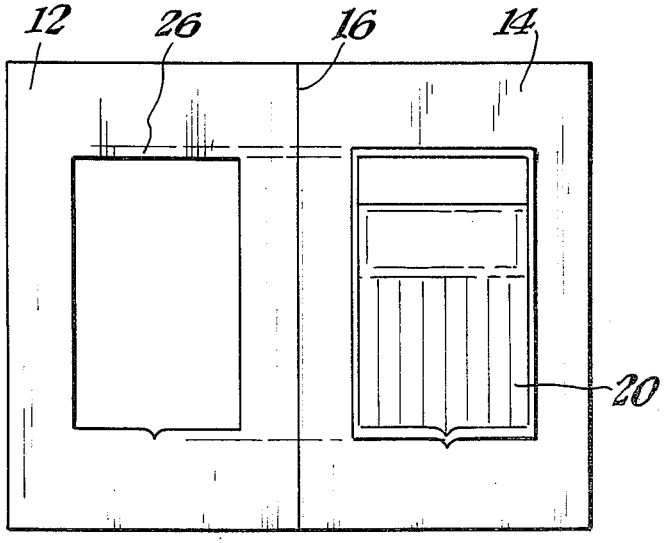
Fig. 4.

GREETING CARD WITH REMOVABLE DECAL

BACKGROUND OF THE INVENTION

This invention relates to a new and improved greeting card, and more particularly to a greeting card containing a detachable decal.

Various mailing cards bearing detachable decals such as shown in U.S. Pat. No. 4,008,852 to Davis and U.S. Pat. No. 2,363,472 to Ritter have been proposed. Usually, in these mailing cards it is difficult to easily remove the decal for reuse because of the adhesive design of the greeting cards.

An additional disadvantage of the prior greeting cards is that they are costly to produce due to the methods used to secure the decals to the cards.

SUMMARY OF THE INVENTION

The present invention relates to a new and improved greeting card with a detachable decal which affords a solution to the problems mentioned above by providing a non-complex, foldable greeting card with an economical method of attaching the removable decal to the greeting card and a non-complex method for removal and reuse of the decal.

It is therefore an object of the present invention to provide a greeting card with a removable decal that can be produced inexpensively.

It is another object of the present invention to provide a greeting card with a removable decal that is secured to the card by a light adhesive means to allow for ease of removal of the decal while the light adhesive means remains adhered to the greeting card.

It is still another object of the present invention to provide an opening in a foldable side of the greeting card for viewing the decal when the card is folded.

It is yet another object of the present invention to provide an opening in a foldable side of a greeting card which is of smaller perimeter than the decal within the card whereby the edge of the opening overlaps the decal to aid in maintaining the decal within the card.

It is a further object of the present invention to provide a greeting card with a removable decal which has an adhesive back with a protective covering.

It is still a further object of the present invention to provide a greeting card with a removable decal which can be applied to another surface upon removal from the greeting card.

In accordance with these and other objects which will be apparent hereinafter, the instant invention will now be described with particular reference to the accompanying drawings.

BRIEF DESCRIPTION OF THE DRAWINGS

FIG. 1 is a perspective view of one embodiment of the present invention in a partially open configuration;

FIG. 2 is a front elevation of the present invention in the closed configuration;

FIG. 3 is a vertical sectional view of FIG. 2 taken along line III—III;

FIG. 4 is an elevation of the inside of the present invention in the opened position.

DESCRIPTION OF THE PREFERRED EMBODIMENT

Referring now to the drawings, in particular to FIG. 1, there is illustrated a mailable greeting card generally designated by the numeral 10, having a front portion 12 and a rear portion 14 generally joined along a common edge 16. The common edge 16 allows the front portion 12 and the rear portion 14 to be folded upon each other (such as would be the position when inserted in an envelope for mailing) or permits the two portions 12 and 14 to be opened away from each other and positioned in a generally singular plane, as shown in FIG. 4.

The greeting card 10 has a detachable decal 20 secured to the rear portion 14 by a light adhesive means 22. The decals 20 may be of various sizes, shapes, and illustrations.

The front portion 12 has an opening 24 therethrough to allow viewing of the decal 20 when the card 10 is in the folded closed position. The opening 24 is of coextensive shape with each different decal 20 secured to each greeting card 10. A border 26 around the opening 24 overlaps the decal 20 when the decal 20 is within the card 10 in the folded closed position as illustrated in FIGS. 2 and 3.

The decal 20 is removably secured to the rear portion 14 of the greeting card by a light adhesive 22 between the rear portion 14 and a removable backing sheet 28. The removable backing sheet 28 may be waxed to permit removal of the decal without removing any of the light adhesive. When the decal 20 is removed from the greeting card 10, the removable backing sheet 28 may be separated from the decal thereby exposing a permanent adhesive 32 which allows the decal to be transferred to another surface.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A mailable greeting card, comprising:

a first section having a detachable decal assembly secured thereto by a first adhesive, said detachable decal assembly includes:

a decal including an indicia bearing face and a back, a permanent adhesive connected to said back, a removable backing sheet having one surface removably connected to and over said permanent adhesive, said removable backing sheet having a second surface connected to said first adhesive, and a second section foldably connected to said first section, said second section having an opening therethrough in general alignment with said detachable decal assembly for exposing said indicia bearing face for viewing when said second section is folded upon said first section.

2. A mailable greeting card as set forth in claim 1, wherein:

said permanent adhesive binds said decal to said backing sheet stronger than said first adhesive binds said detachable decal assembly to said card, whereby said detachable decal assembly may be easily removed for later use and permanent attachment to another surface from said backing sheet.

* * * * *